United States Patent [19]

Scholl et al.

[11] Patent Number: 4,574,718

[45] Date of Patent: Mar. 11, 1986

[54] SEWING MACHINE HEAD INCLUDING A ROTARY HOUSING

[75] Inventors: Hans Scholl, Oerlinghausen-Lipperreihe; Jochen Fischer, Detmold, both of Fed. Rep. of Germany

[73] Assignee: Kochs Adler, AG, Fed. Rep. of Germany

[21] Appl. No.: 657,025

[22] Filed: Oct. 2, 1984

[30] Foreign Application Priority Data

Oct. 8, 1983 [DE] Fed. Rep. of Germany ..... 3336683

[51] Int. Cl.[4] ..... D05B 21/00

[52] U.S. Cl. ..... 112/121.12; 112/121.15; 112/259

[58] Field of Search ..... 112/121.15, 121.12, 112/70, 73, 259, 321

[56] References Cited

U.S. PATENT DOCUMENTS 4,344,375 8/1982 Tolle ..... 112/70 X
4,347,797 9/1982 Scholl et al. .
4,419,946 12/1983 Fischer et al. ..... 112/121.12

FOREIGN PATENT DOCUMENTS 1158800 1/1962 Fed. Rep. of Germany .
2017769 10/1979 United Kingdom ..... 112/121.15

*Primary Examiner*—Werner H. Schroeder
*Assistant Examiner*—Andrew M. Falik
*Attorney, Agent, or Firm*—Laff, Whitesel, Conte & Saret

[57] ABSTRACT

A sewing device with a sewing head and a feeding device for generating a two-axis-relative motion of a constant velocity between a workpiece to be stitched wherein the sewing head has a rotary housing pivoted about an axis of rotation at the sewing head. In the housing, a needle bar including a needle is pivoted and the needle bar essentially extends about the axis of rotation. The housing further has a common drive for a thread take-up means and a crank including a jogging gear, wherein the two latter cooperate to produce a needle feed movement. The rotary housing is rotatably controlled together with a bearing bracket including a hook, in order to render possible sewing of a stitch contour, wherein the needle feed movement is tangentially guided relative to the individual sewing direction.

6 Claims, 6 Drawing Figures

SEWING MACHINE HEAD INCLUDING A ROTARY HOUSING

FIELD OF THE INVENTION

The present invention generally relates to a sewing device having a sewing head including a rotary housing, which, in particular, renders possible the generation of a stitch contour according to a predetermined profile in a workpiece by means of a tangentially controlled needle feed movement with respect to the individual sewing direction while a relative movement of a constant velocity is generated between the workpiece and the housing.

BACKGROUND OF THE INVENTION

German Auslegeschrift No. 1 158 800 decribes an automatic sewing machine having a sewing head including a rotary housing arranged at an arm and a rotatably received hook bearing. Both the hook bearing and the rotary housing are synchronously rotatable about a common axis which essentially corresponds to the longitudinal axis of the needle. The rotary housing and the hook bearing are driven by a control motor operably connected to sensors which are guided by a trace line corresponding to the profile of a stitch contour to be produced. The sewing head is displaceable in two axes at a constant velocity with respect to the stationary workpiece. The needle bar in conjunction with an associated presser foot are arranged in a frame and a needle feed movement is opposite of the displacement direction of the movable sewing head with respect to the stationary workpiece displaceable by means of an eccentric drive. Similarly, the hook cooperating with the needle, is displaceably received in the housing of the hook bearing and operably connected to an eccentric controlling the axial displacement of the hook. In order to achieve this, the shafts and the gears for the needle bar drive and the hook drive are axially displaceable constructed. Further, in the rotary housing there is arranged a thread take-up lever and a thread tensioner. The drives of both cannot easily be released due to the displaceable arrangement of the needle bar frame. By the rotatability of the rotary housing and the hook bearing, tangential needle feed movement with respect to the sewing direction of the seam at the individual point of stitching is provided so that no mentionable forces of displacement occur relative between the workpiece and the needle. This patent does not disclose a sewing head housing having a first drive connection for connecting a crank means to a jogging means and a second drive connection for connecting the crank means to a thread take-up means. Other distinctions will be apparent from reading the following detailed description.

U.S. Pat. No. 4,347,797 describes an automatic sewing machine including a sewing head and a feeding device for the workpiece to be stitched that generates both, a two axis relative movement and a rotating movement at the workpiece with respect to the stationary sewing head to provide a tangential movement each between the needle feed movement and the workpiece relative to the stitch row to be produced. However, because of its construction, it is possible only to sew certain sizes of workpieces, as the workpiece hanging over the supporting plate cannot be tilted about the sewing head exceeding a certain angle. Due to the fact that the total of all movements required for the so-called tangential sewing must be carried out by the workpiece, the individual plies of the latter to be stitched together are strongly exposed to forces of displacement with respect to each other. Furthermore, larger workpieces can only be rotated or tilted slowly resulting in an extension of the sewing cycle.

SUMMARY OF THE INVENTION

It is an object of the present invention to provide an automatic sewing device capable of performing tangential sewing, at which the workpiece plies are exposed to a minimum of displacement forces.

Another object of the invention is to provide an automatic sewing device of the aforesaid character rendering possible an increase of production due to the reduction of sewing cycle time.

One feature of the invention is to provide a simple construction by the needle feed movement being generated by the drive of both the crank mechanism for the reciprocating needle as well as the needle jogging mechanism. According to this feature of the invention it is possible to employ usual sewing machine parts.

According to another feature of the invention a simple and a space saving construction is achieved by the type of integration of the needle jogging mechanism in the rotary housing.

Other objects, advantages and features of the present invention will become clearer after reading the following detailed description of the preferred embodiment, which is explained in conjunction with the accompanying drawings.

DESCRIPTION OF THE PREFERRED EMBODIMENT

Figure 1:
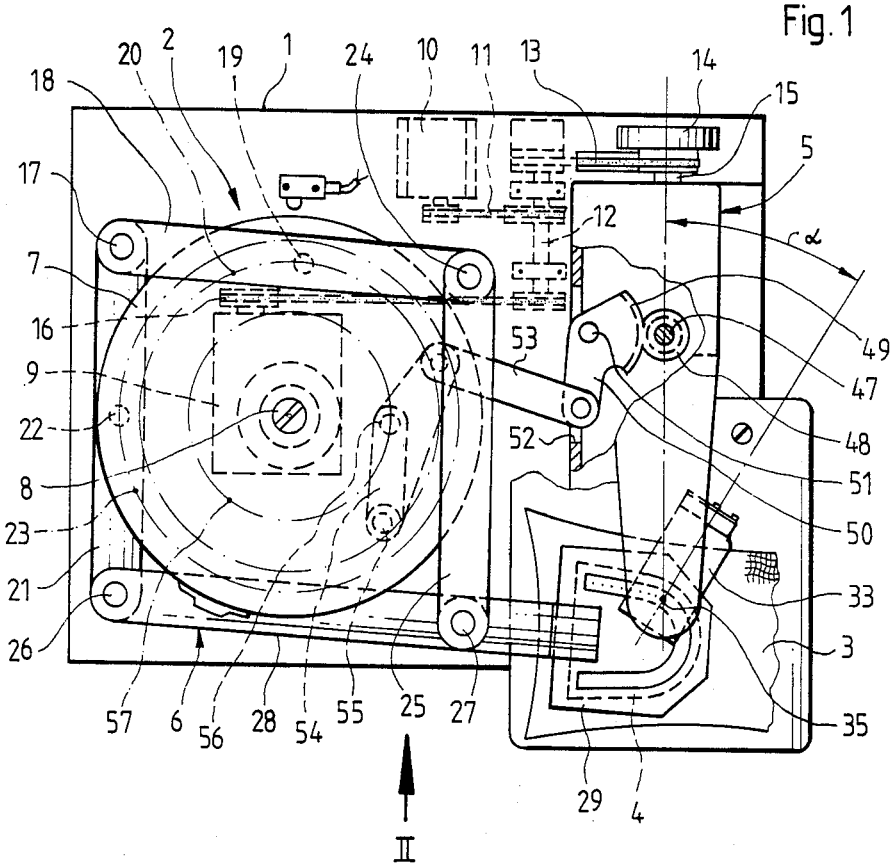
FIG. 1 is a top plan view of an automatic sewing device for attaching pocket cuts onto a workpiece.

Referring to the drawings there is illustrated an automatic sewing device mounted to a stand or base 1 having movable thereon a feeding device 2 and a sewing head 5. The feeding device 2 feeds a workpiece 3 and a workpiece cut 4 to be sewn to the workpiece.

The feeding device 2 is provided with a link system 6, which, in principle, defines a link square cooperating with a control cam 7. The control cam 7 is mounted to an off-drive shaft 8 of a gear 9 fastened to the stand 1. The control cam 7 is rotatably driven via the gear 9 which is turned by a drive motor 10. The drive motor 10 drives, via a belt drive 11, an intermediate drive or shaft 12, which in turn drives, via a futher belt drive 13, a main drive shaft 15 of the sewing head 5. The outer end of the main drive shaft 15 has connected thereto a hand wheel 14. A third belt drive 16 connects the intermediate drive 12 with the gear 9.

The link system 6 has a stationary point of rotation defined by an axis 17, which is fixedly attached to the stand 1. One end of a lever 18 is pivotally or swingably connected to the axis 17. The lever 18 extends above the control cam 7 and is substantially vertical or perpendicular to the main direction of the sewing head 5. The lever 18 has a cam follower 19 on its inner surface that engages a groove 20 located in the upper surface of the control cam 7.

A second lever 21 has one end thereof connected to the axis 17. The lever 21, extends below the control cam 7 and extends substantially vertical or perpendicularly to the upper lever 18, i.e. parallel with the main direction of the sewing head 5. Also lever 21 has a cam follower 22 for engaging a groove 23 formed in the lower surface of the control cam. The groves 20 and 23 extend as closed curves around the whole periphery of the control cam 7. The grooves 20 and 23 are not circularly profiled.

The other end of the upper lever 18 is linked or connected to one end of an intermediate lever 25, via a link 24. The intermediate lever 25 extends above the control cam 7 and is substantially parallel to the lower lever 21. The other ends of the lower lever 21 and the intermediate lever 25 are linked or connected via links 26 and 27 to an off-drive lever 28 extending parallel to the upper lever 18. The off-drive lever 28 is located below the control cam 7. As obvious from FIG. 1, the link system 6 defined by the four joints 17, 24, 26, 27 is formed as a rectangular parallelogram with almost equal legs. To the off-drive lever 28 there is connected a workpiece holder 29 for receiving the workpiece 3 and the workpiece cut 4. The automatic sewing device is described above in principle as known from the U.S. Pat. No. 4,347,797.

The sewing head 5 has a vertically extending standard 30. An upper arm 31 and the lower base plate 32 extend in a horizontal plane from the standard 30. A rotary housing 33 is swingably supported about an axis 34 on the lower surface of the free end of the upper arm 31. In the axis 34 there is also arranged a needle bar 36 carrying a needle 35. The rotary housing 33 is fastened by screws 37 to a flange 38 of a hollow shaft or axle 39. The hollow shaft 39 extends into the upper arm 31 coaxially with the axis 34 and is supported in a bearing 40. A first timing belt pulley 41 is attached to the hollow shaft 39 by a key-slot connection 42. A first timing belt 43 drivingly connects the timing belt pulley 41 to a second timing belt pulley 44. The second timing belt pulley is attached to an upper end of a shaft 47. The shaft 47 is supported in the standard 30 by bearings 45, 46, therein. The lower portion of the shaft 47 carries a gear wheel 48. Referring to FIG. 1, an angle lever 50 is swingably connected via a connecting lever 53 to a control lever 54. The control lever 54 is supported about a stationary axis of rotation 55 located in the stand 1. One end of the angle lever has a tooth segment 49 that meshes with the gear wheel 48. The angle lever 50, in the area between the standard 30 and the base plate 32, is pivoted about an axis of rotation 51 and guided through an opening 52 in the base plate 32. The control lever 54 has supported thereon a cam follower 56 engaging a closed groove 57 formed at the lower surface of the control cam 7. The aforesaid described drive 58 drives the rotary housing 33 synchronously with respect to the drive of the workpiece holder 29, so that, as still described hereinafter, the needle 35 moves always tangentially with respect to the course of the seam.

Figure 3:
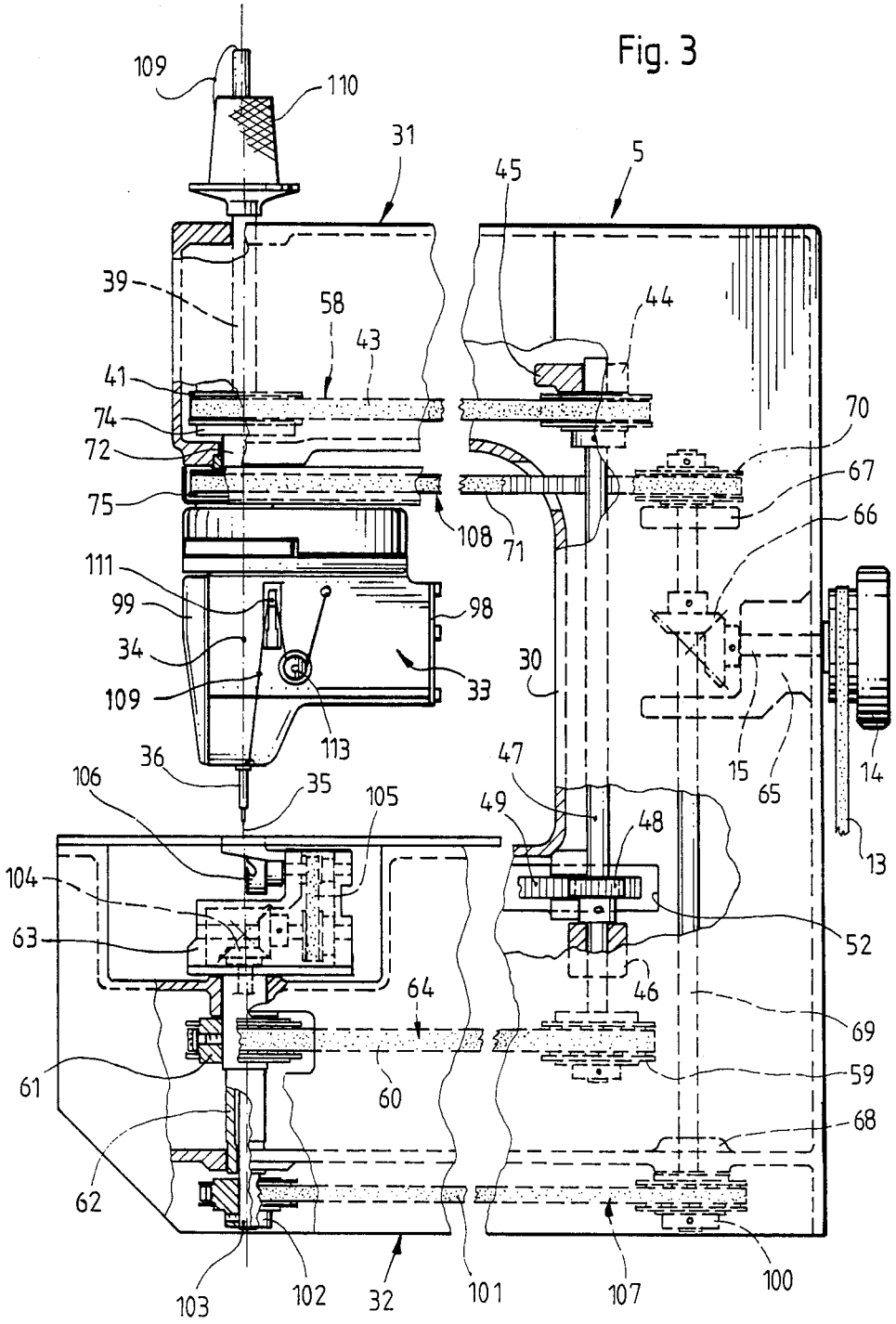
FIG. 3 shows the sewing head of the automatic sewing device according to the arrow III in FIG. 2, with the rotary housing swung into a neutral position, on an enlarged scale with respect to FIGS. 1 and 2.

Referring to FIG. 3, a third timing belt pulley 59 is attached to the lower end of the shaft 47 and connected, via a second timing belt 60, to a fourth timing belt pulley 61. The fourth timing belt pulley 61 is attached to a hollow shaft 62. The hollow shaft 62 is supported concentrically with respect to the axis 34 in the base plate 32. A hook bearing 63 is mounted on the upper end of the hollow shaft 62. This forms a hook bearing drive 64 that moves the hook bearing 63 equiangularly with respect to the rotary housing 33.

Figure 4:
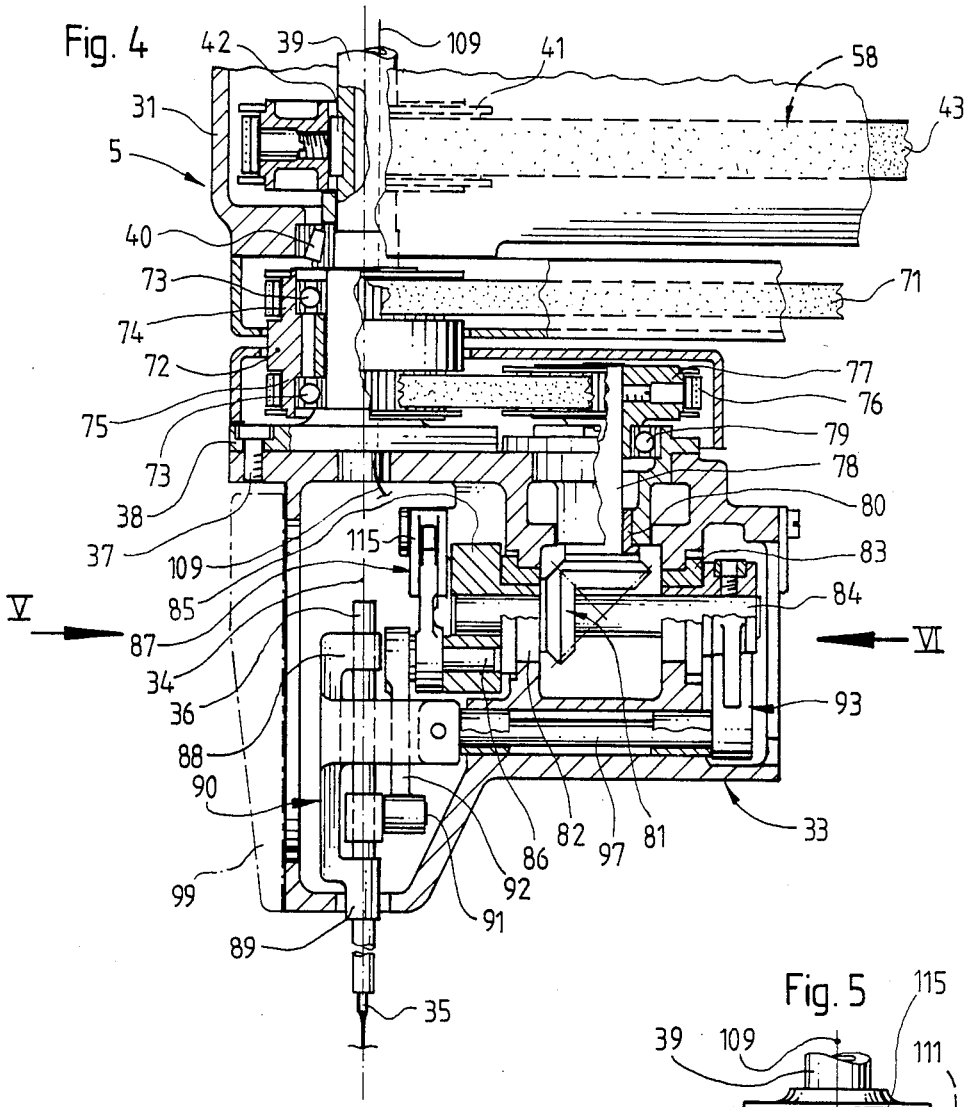
FIG. 4 is a vertical longitudinal center section through the rotary housing, on an enlarged scale with respect to FIG. 3.

Referring to FIGS. 3 and 4, the main drive shaft 15 is supported in a bearing 65 within the standard 30 drives via a bevel gear drive 66 a vertical shaft 69. The shaft 69 is supported in bearings 67 and 68 within the standard 30. At the upper end of the shaft 69 there is attached a fifth timing belt pulley 70 for driving via a fourth timing belt 71, a double timing belt pulley 72. The pulley 72 is connected to the shaft 39 by bearings 73 and is concentric with respect to the axis 34. The fourth timing belt 71 is guided around an upper part 74 of the double timing belt pulley 72. A fifth timing belt 76 is guided around a lower part 75 of the double timing belt pulley 72 to a sixth timing belt pulley 77. The sixth timing belt pulley 77 is mounted to a shaft 78. The shaft 78 is supported in bearings 79 and 80 within the rotary housing 33 and drives, via a bevel gear drive 81, a shaft 84. The shaft 84 is horizontally supported in bearings 82 and 83 in the rotary housing 33. The end of the shaft 84 adjacent to the needle bar 36 carries a crank 85 for driving, via a crank pin 86, a thread take-up drive mechanism 87 and the needle bar 36.

The needle bar 36 is supported in an upper bearing 88 and a lower bearing 89 of a needle bar bearing frame 90 and axially displaceable in longitudinal direction. Between the bearings 88 and 89 a drive bolt 91 is fastened to the needle bar 36. A crank lever 92 is rotatably arranged on the drive bolt 91 and connected to the crank pin 86 of the crank 85, so that the shaft 84 effects the oscillatory motion of the needle bar 36.

Figure 6:
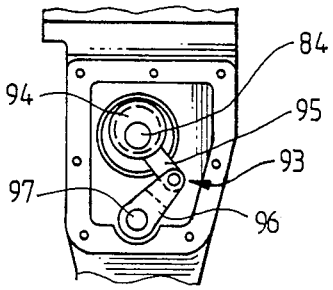
FIG. 6 is a side elevation of the rotary housing according to the arrow VI in FIG. 4, on a reduced scale with respect to FIG. 4.

Referring to FIGS. 4 and 6, the other end of the shaft 84, away from the needle bar 36, is provided with a jogging gear 93 having an eccentric 94 arranged on the shaft 84 and hingedly connected via a tie rod 95 to a crank 96. The crank 96 is secured to a shaft 97, which is supported below and parallelly with respect to the shaft 84 in the rotary housing 33. The needle bar bearing frame 90 is secured to the shaft 97, so that a vibratory motion (needle feed) is performed while the needle bar 36 moves up and down.

The rotary housing 33 has removable covers 98, 99 at the side of the jogging gear 93 and at the side of the needle bar 36.

Figure 5:
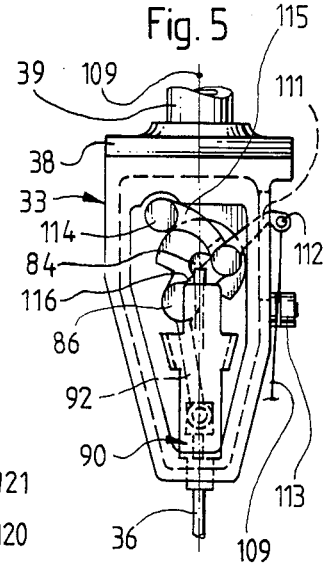
FIG. 5 is a side elevation of the rotary housing according to the arrow V in FIG. 4, on a reduced scale with respect to FIG. 4.

Referring to FIGS. 3 and 5, a seventh timing belt pulley 100 is attached to the lower end of the shaft 69. The seventh pulley 100 drives, via a fifth timing belt 101, an eighth timing belt pulley 102, which in turn is arranged on a hook shaft 103. The shaft 103 is supported in a hollow shaft 62. The hook shaft 103 drives a hook 106 having a horizontal axis of rotation, via a bevel gear drive 104 and a timing belt drive 105 supported in the hook bearing 63. The hook 106 is also supported in the hook bearing 63. The afore described total hook drive is denoted as 107. The drive derived from the timing shaft 69 via the timing belt 71 for driving the needle bar 36, the jogging gear 93 and the thread take-up drive mechanism 87 is denoted as 108. The needle thread 109 carried by the needle 35 is pulled off from the thread supply 110 and guided to the thread take-up drive mechanism 87 which has a double-armed thread take-up lever 111. The upper end of the thread take-up lever 111 projects from the rotary housing 33 and has an eye 112. The lower end 116 of the thread take-up lever 111 is pivotally connected to the crank pin 86. Also, the thread take-up lever 111 is hingedly connected to a not denoted point of rotation to one end of a lever 115. The other end of the lever 115 is swingably connected to a stationarily arranged bolt 114 in the rotary housing 33. The needle thread 109 is guided through a not denoted opening (see FIG. 3) of the rotary housing 33 to a thread tensioner 113 and from here through the eye 112 to the needle 35.

Figure 7:
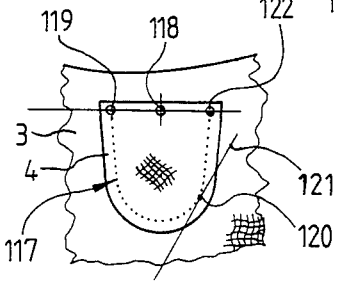
FIG. 7 shows a workpiece with a pocket cut sewn thereon.

Operation is described as follows: The grooves 20 and 23 of the control cam 7 of the feeding device 2 are profiled to correspond to the workpiece cut 4 (in this case a pocket cut) to be sewn onto the workpiece 3 by means of a seam 117. While the workpiece 3 together with the workpiece cut 4 is loaded or removed, the needle 35 is positioned with respect to the workpiece holder 29 in an intermediate point 118 (FIG. 7). This intermediate point 118 is reached by moving the workpiece 3 together with the workpiece cut 4 to the intermediate point 118 after termination of the seam 117 and without sewing from the end point 119 of the seam 117. While the workpiece holder 29 together with the workpiece 3 and the workpiece cut 4 moves from the end point 119 to the intermediate point 118, the rotary housing 33 and the hook bearing 63 are returned into a neutral starting position (FIG. 3) due to the correspondingly profiled groove 57. The needle feed motion is performed extending in a vertical plane with respect to the plane of the drawing as it is commonly known from sewing machines provided with a feed drive.

The action of the jogging gear 93 causes a superposition of the oscillatory motion of the needle 35 with a vibratory motion of the needle bar bearing frame 90, so that the not illustrated point of the needle 35 performs a closed elliptical path, i.e. the needle 35 performs the already described needle feed motion. The closed elliptical path of the needle 35 as used herein is generally known in the area of sewing machines having a needle-feed-movement and that insofar as this feature is concerned, U.S. Pat. No. 4,347,797 is incorporated by reference. The needle 35 receives in its upper respectively lower dead center of the ellipitical path a usual vertically directed position, which corresponds to the axis 34. The largest angle of deviation of the needle 35 with respect to the axis 34 measures about 1°.

The feeding device 2 continuously displaces the workpiece holder 29 in such a manner, that the workpiece 3 together with the workpiece cut 4 is moved relative to the needle 35 according to the course of the seam 117. Due to the groove 57, the drive 58 of the rotary housing 33 causes, the needle feed motion to be performed at each stitching point 120 in a tangential direction 121 with respect to the seam 117 as shown in FIG. 7. The hook bearing drive 64 ensures that the hook 106 is always positioned in the right position. While sewing the seam 117 from the seam starting point 122 to the seam end point 119, the workpiece 3 together with the workpiece cut 4 are exposed to a minimum of displacing forces.

While the rotary housing 33 is rotated, the thread take-up lever 111 is rotated. Also the thread supply is not subject to alterations because the thread is guided through the hollow shaft 39 and the thread supply 110 is commonly rotated with the hollow shaft 39.

Figure 2:
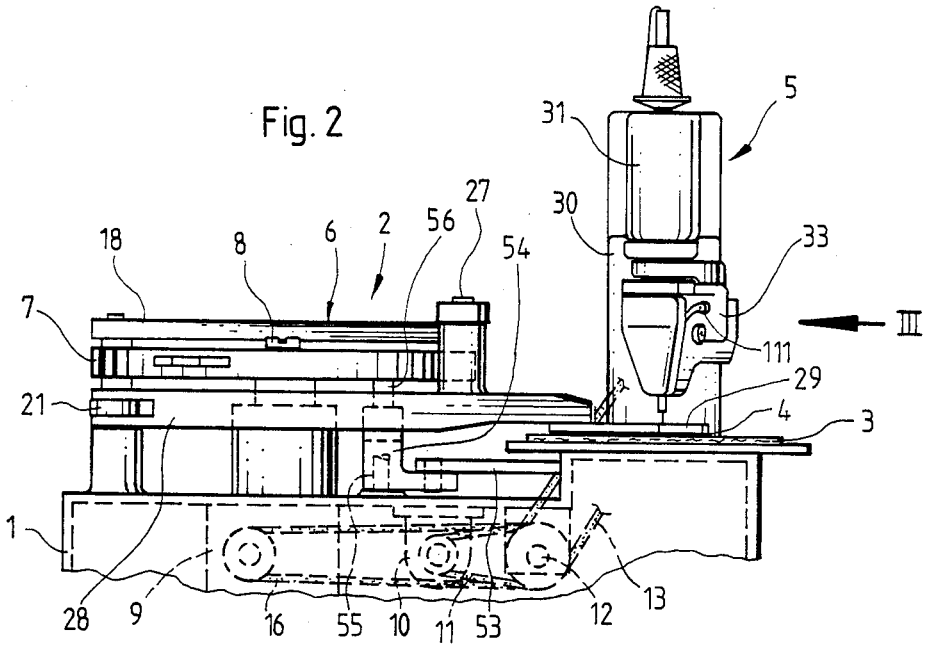
FIG. 2 is a front view of the automatic sewing device according to the arrow II in FIG. 1.

In FIGS. 1 and 2 there is illustrated how the rotary housing 33 is turned by an angle $\alpha$ at the stitching point 120 (FIG. 7) for reaching the tangential direction with respect to the normal position. As can be seen from the drawings, FIG. 1 shows a partially not yet terminated seam, whereas FIG. 7 shows the terminated seam 117.

What is claimed is:

1. A sewing device having:

a sewing head;

a feeding means for producing a two-axis-relative-movement between said sewing head and a workpiece to be sewn;

a drive means connected to said sewing head and said feeding means;

said sewing head having:

a housing rotatably arranged at said sewing head about an axis of rotation, said housing having therein;

crank means operable by said drive means, a bearing frame displaceably fastened to said housing, gear means to impart jogging movements to said bearing frame a needle bar longitudinally displaceably received in said bearing frame link means drivingly connecting said crank means with said needle bar as to superpose a reciprocating motion with said jogging movements resulting in a needle-feed-movement, wherein said reciprocating needle bar is joggingly driven laterally relative to said axis of rotation, and a thread take-up means handling thread;

a bearing including a hook, said bearing being rotatably arranged about said axis of rotation, transmitting means for equiangularly rotating said housing and said bearing, and a control including a drive for rotating said housing and said bearing, said housing further having:

a first drive connection for connecting said crank means to said jogging means and a second drive connection for connecting said crank means to said thread take-up means.

2. A sewing device according to claim 1, wherein said first and said second drive connections are formed by a shaft pivoted in said housing and drivingly connected to said drive means for commonly driving said gear means and said crank means operably connected with said thread take-up means.

3. A sewing device according to claim 2 wherein, said housing comprises another shaft transmitting said jogging movements from said gear means, to said bearing frame and said gear means having an eccentric and connecting links.

4. A sewing device according to claim 2, wherein one end of said shaft is connected to said crank means, said crank means operably connected to said thread take-up means and the other end of said shaft is connected to a drive element of said gear means.

5. A sewing device having:

a sewing head;

a feeding means for producing a two-axis-relative-movement between said sewing head and a work-piece to be sewn;

a drive means connected to said sewing head and said feeding means;

said sewing head having:

a housing rotatably arranged at said sewing head about an axis of rotation, said housing having therein;

a shaft pivoted in said housing and operably connected to said drive means a bearing frame displaceably fastened to said housing, gear means drivingly connected to said shaft to impart jogging movements to said bearing frame, a needle bar longitudinally displaceably received in said bearing frame, crank means firmly arranged at the end of said shaft directed to said needle bar, link means drivingly connecting said crank means with said needle bar as to superpose a reciprocating motion with said jogging movements resulting in a needle-feed-movement, wherein said reciprocating needle bar is joggingly driven laterally relative to said axis of rotation, and a thread take-up means handling thread; a bearing including a hook operable by said drive means and cooperating with a needle, said bearing being rotatably arranged about said axis of rotation, and transmitting means for equiangularly rotating said housing and said bearing, and a control including a drive for rotating said housing and said bearing, said crank means having a drive connection for driving said thread take-up means.

6. A sewing device according to claim 5, wherein said gear means is formed with an eccentric and connecting links, said eccentric being fastened to said shaft.

* * * * *